US011732549B2

(12) United States Patent
Egbe

(10) Patent No.: US 11,732,549 B2
(45) Date of Patent: Aug. 22, 2023

(54) CEMENT PLACEMENT IN A WELLBORE WITH LOSS CIRCULATION ZONE

(71) Applicant: Saudi Arabian Oil Company, Dhahran (SA)

(72) Inventor: Peter Ido Egbe, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 287 days.

(21) Appl. No.: 17/111,251

(22) Filed: Dec. 3, 2020

(65) Prior Publication Data

US 2022/0178224 A1 Jun. 9, 2022

(51) Int. Cl.
*E21B 33/16* (2006.01)
*E21B 23/06* (2006.01)

(52) U.S. Cl.
CPC ..... *E21B 33/16* (2013.01); *E21B 23/06* (2013.01)

(58) Field of Classification Search
CPC ..... E21B 33/134; E21B 33/16; E21B 33/146
See application file for complete search history.

(56) References Cited

U.S. PATENT DOCUMENTS

| | | | |
|---|---|---|---|
| 2,014,563 A | 9/1935 | Halliburton | |
| 2,058,688 A | 10/1936 | Halliburton | |
| 2,801,715 A | 8/1957 | Hall | |
| 2,830,540 A | 4/1958 | Vincent | |
| 4,441,556 A | 4/1984 | Powers et al. | |
| 5,314,015 A | 5/1994 | Streich et al. | |
| 6,578,638 B2 | 6/2003 | Guillory et al. | |
| 7,108,080 B2 | 9/2006 | Tessari et al. | |
| 7,581,595 B2 | 9/2009 | Fay et al. | |
| 7,717,179 B2 | 5/2010 | Raysiguier et al. | |
| 9,909,378 B2 | 3/2018 | Myhre et al. | |
| 9,970,258 B2 | 5/2018 | Barannikow et al. | |
| 2012/0247767 A1* | 10/2012 | Themig | E21B 33/146 166/321 |
| 2012/0261127 A1 | 10/2012 | Zhou | |
| 2017/0342800 A1* | 11/2017 | Themig | E21B 33/146 |
| 2020/0332624 A1 | 10/2020 | Hijles | |

FOREIGN PATENT DOCUMENTS

| | | |
|---|---|---|
| EP | 2594731 | 5/2013 |
| EP | 2835493 | 2/2015 |

OTHER PUBLICATIONS

PCT International Search Report and Written Opinion in International Appln. No. PCT/US2021/061707, dated Apr. 5, 2022, 15 pages.

* cited by examiner

*Primary Examiner* — Cathleen R Hutchins
(74) *Attorney, Agent, or Firm* — Fish & Richardson P.C.

(57) ABSTRACT

A method includes deploying a cementing assembly within a wellbore. The wellbore includes a loss circulation zone. The cementing assembly includes a work string and a liner assembly coupled to the work string. The liner assembly includes a polished bore receptacle, a liner hanger attached to a downhole end of the polished bore receptacle, a liner, and a cementing sub disposed between the liner hanger and the liner. The method includes anchoring the liner hanger on the casing of the wellbore, cementing an open hole annulus of the wellbore, and setting an annulus packer of the cementing sub on the. The method also includes cementing a casing annulus of the wellbore defined between an external surface of the cementing sub and a wall of wellbore.

21 Claims, 7 Drawing Sheets

CEMENT PLACEMENT IN A WELLBORE WITH LOSS CIRCULATION ZONE

FIELD OF THE DISCLOSURE

This disclosure relates to wellbores, in particular, to methods and equipment for cementing wellbores.

BACKGROUND OF THE DISCLOSURE

Wellbores are constructed and prepared for production by disposing casing pipe into the wellbore and cementing the casing into place. Cementing the casing into place seals the annulus and creates a wall that isolates the production fluid from the formation wall. A liner is a section of casing that does not extend to the top of the wellbore. The liner can be used to cement a portion of the wellbore. Methods and equipment for improving cementing operations are sought.

SUMMARY

Implementations of the present disclosure include a method that includes deploying a cementing assembly within a wellbore. The wellbore includes a casing and an open hole section extending between the casing and a downhole end of the wellbore. The wellbore includes a loss circulation zone at the open hole section. The cementing assembly includes a work string and a liner assembly coupled to the work string. The liner assembly includes a polished bore receptacle, a liner hanger attached to a downhole end of the polished bore receptacle, a liner, and a cementing sub attached to and disposed between the liner hanger and the liner. The method also includes anchoring the liner hanger on the casing of the wellbore with the liner disposed at the open hole section of the wellbore. The method also includes cementing an open hole annulus of the wellbore defined between an external surface of the liner and a wall of the open hole section of the wellbore. The open hole annulus extends between the loss circulation zone and the downhole end of the wellbore. The method also includes setting an annulus packer of the cementing sub on the casing of the wellbore or the wall of the open hole section of the wellbore. The annulus packer is disposed uphole of the loss circulation zone. The method also includes cementing a casing annulus of the wellbore defined between an external surface of the cementing sub and a wall of wellbore. The casing annulus extends uphole from the annulus packer.

In some implementations, cementing the open hole annulus includes fluidically coupling the work string with the liner, and then flowing cement through the work string, into the liner, and out an open end of the liner into the open hole annulus of the wellbore.

In some implementations, the cementing sub includes a spring loaded mandrel movable in a direction parallel to a length of the cementing sub. The mandrel engages the annulus packer. Setting the annulus packer includes pushing downhole, with the work string, the mandrel until the mandrel engages the annulus packer to activate the annulus packer. In some implementations, the mandrel includes an arm configured to extend through a longitudinal slot of the cementing sub. Setting the annulus packer includes pushing downhole, with the work string, the mandrel moving the arm along the longitudinal slot until the activation arm engages the annulus packer to activate the annulus packer. In some implementations, the work string includes an outwardly projecting shoulder and the spring loaded mandrel includes an inwardly projecting seat configured to receive and form a fluid seal, with the outwardly projecting shoulder, between a bore section of the cementing sub upstream of the seat and a bore section of the cementing sub downstream of the seat. Pushing the mandrel includes exposing a fluid port of the cementing residing at the bore section of the cementing sub upstream of the seat. Cementing the casing annulus includes flowing cement through the work string, into the bore section of the cementing sub upstream of the seat, and through a fluid port of the cementing sub into the casing annulus. In some implementations, the work string includes a spring loaded ball seat movable in a direction parallel to a length of the work string, and cementing the casing annulus includes closing, with a ball landed on the ball seat, a fluid pathway of the work string. Cementing the casing annulus also includes flowing cement through the work string to push downhole, with pressure applied by the cement, the ball seat exposing a fluid port of the work string. Cementing the casing annulus also includes flowing the cement through the fluid port of the work string into the bore section of the cementing sub upstream of the seat, and through the fluid port of the cementing sub into the casing annulus.

In some implementations, anchoring the liner hanger includes dropping a ball on a ball seat of the work string, and hydraulically activating slips of the liner hanger.

In some implementations, the method further includes, after cementing the casing annulus, setting a packer of the liner hanger. In some implementations, setting the packer of the liner hanger includes dropping a ball on a ball seat of the work string, and hydraulically activating the packer of the liner hanger.

Implementations of the present disclosure include a wellbore assembly that includes a work string and a liner assembly. The work string is disposed within a wellbore that includes a casing and an open hole section extending between the casing and a downhole end of the wellbore. The wellbore includes a loss circulation zone at the open hole section of the wellbore. The liner assembly is releasably coupled to a downhole end of the work string. The liner assembly includes a polished bore receptacle and a liner hanger attached to a downhole end of the polished bore receptacle. The liner hanger is fluidically coupled to the work string and includes a packer configured to be set on the casing by fluidic pressure from the work string. The liner assembly also includes a liner, and a cementing sub attached to and disposed between the liner hanger and the liner. The cementing sub includes an annulus packer configured to be set on a wall of the wellbore uphole of the loss circulation zone. The cementing sub includes an internal mandrel movable in a direction parallel to a length of the cementing sub to activate the packer and to expose or cover a fluid port of the cementing sub such that, when exposed, the fluid port fluidically couples a bore of the cementing sub with a casing annulus defined between an external surface of the collar sub and the wall of the wellbore. The casing annulus extends uphole from the annulus packer.

In some implementations, at least a portion of the work string is configured to extend inside the polished bore receptacle, with an end of the work string configured to be attached to a bore of the liner hanger.

In some implementations, the work string includes a ball seat configured to receive a ball blocking a fluid pathway of the work string to hydraulically activating the liner hanger. In some implementations, the packer of the liner hanger is configured to be set hydraulically under pressure applied by fluid stopped at the ball seat.

In some implementations, the work string is configured to flow cement from a surface of the wellbore to an open end of the work string into the liner. The liner is configured to flow the cement received from the work string to a float shoe of the liner and out the liner into an open hole annulus of the wellbore defined between an external surface of the liner and a wall of the open hole section of the wellbore. The open hole annulus extends between the loss circulation zone and the downhole end of the wellbore.

In some implementations, the cementing sub includes an internal spring configured to urge the internal mandrel in an uphole direction to cover the fluid port of the cementing sub. The internal mandrel includes a seat and the work string includes a shoulder configured to engage the seat to push the mandrel in a downhole direction thereby compressing the spring and uncovering the fluid port. The internal mandrel is configured to engage, with the spring compressed, the annulus packer to set the annulus packer. In some implementations, the mandrel includes an arm configured to extend through a longitudinal slot of the cementing sub and configured to activate, with the spring compressed, the annulus packer to set the annulus packer. In some implementations, the shoulder is configured to form, with the shoulder of the work string, a fluid seal between a bore section of the cementing sub upstream of the seat and a bore section of the cementing sub downstream of the seat to prevent cement from flowing into the bore section of the cementing sub downstream of the seat during cementing of the casing annulus.

In some implementations, the work string includes a movable ball seat and an internal spring configured to urge the ball seat in an uphole direction to cover a fluid port of the work string. The ball seat receives a ball that, when disposed on the ball seat, prevents fluid from flowing into the liner. The spring is configured to be compressed under fluidic pressure from the work string to allow the ball seat to move downhole thereby uncovering the fluid port of the work string to establish a fluid pathway between a bore of the work string and a bore of the cementing sub to cement the casing annulus.

Implementations of the present disclosure include a cementing assembly that includes an activation sub fluidically coupled to a work string configured to be disposed within a wellbore that includes a casing and an open hole section extending between the casing and a downhole end of the wellbore. The wellbore includes a loss circulation zone at the open hole section of the wellbore. The cementing assembly also includes a liner assembly releasably coupled to the activation sub. The liner assembly includes a liner hanger fluidically coupled to the activation sub and includes a packer configured to be set on the casing by fluidic pressure from the work string. The liner assembly also includes a liner and a cementing sub attached to and disposed between the liner hanger and the liner. The cementing sub includes an annulus packer. The cementing sub sets, under string weight applied by the work string, the annulus packer on a wall of the wellbore uphole of the loss circulation zone, to allow cementing of a casing annulus. The casing annulus is defined between an external surface of the collar sub and the wall of the wellbore, and extends uphole from the annulus packer.

In some implementations, the cementing sub includes an internal mandrel movable by the weight applied by the work string in a direction parallel to a length of the cementing sub to activate the packer and to expose or cover a fluid port of the cementing sub such that, when exposed, the fluid port fluidically couples a bore of the cementing sub with the casing annulus to allow cement to be flown to the casing annulus.

DETAILED DESCRIPTION OF THE DISCLOSURE

The present disclosure describes a cementing assembly used to cement a wellbore with one or more loss circulation zones. The cementing assembly includes a cementing sub or collar sub that has an internal mandrel or collar that is movable to activate an annulus packer and to open ports to cement a wellbore uphole of the loss circulation zone.

Particular implementations of the subject matter described in this specification can be implemented so as to realize one or more of the following advantages. For example, the wellbore assembly of the present disclosure can help cement a wellbore with a loss circulation zone in one trip. Additionally, the wellbore assembly can cement a wellbore with loss circulation without the need of using a tieback seal or a packer assembly with scab liner, which can save time and resources, as well as help avoid the multiple clean up trips needed prior to deploying a tieback seal or packer assembly. Additionally, the wellbore assembly can cement a wellbore with loss circulation without the need of deploying an EZSV cement retainer. In addition, the wellbore assembly can help reduce a risk of requiring multiple cement retainer deployment and clean-up trips, as well as reduce a risk of becoming inadvertently stuck while deploying other plugging assemblies. Lastly, the wellbore assembly can help provide long-term well integrity based on efficient circumferential cement placement.

Figure 1:
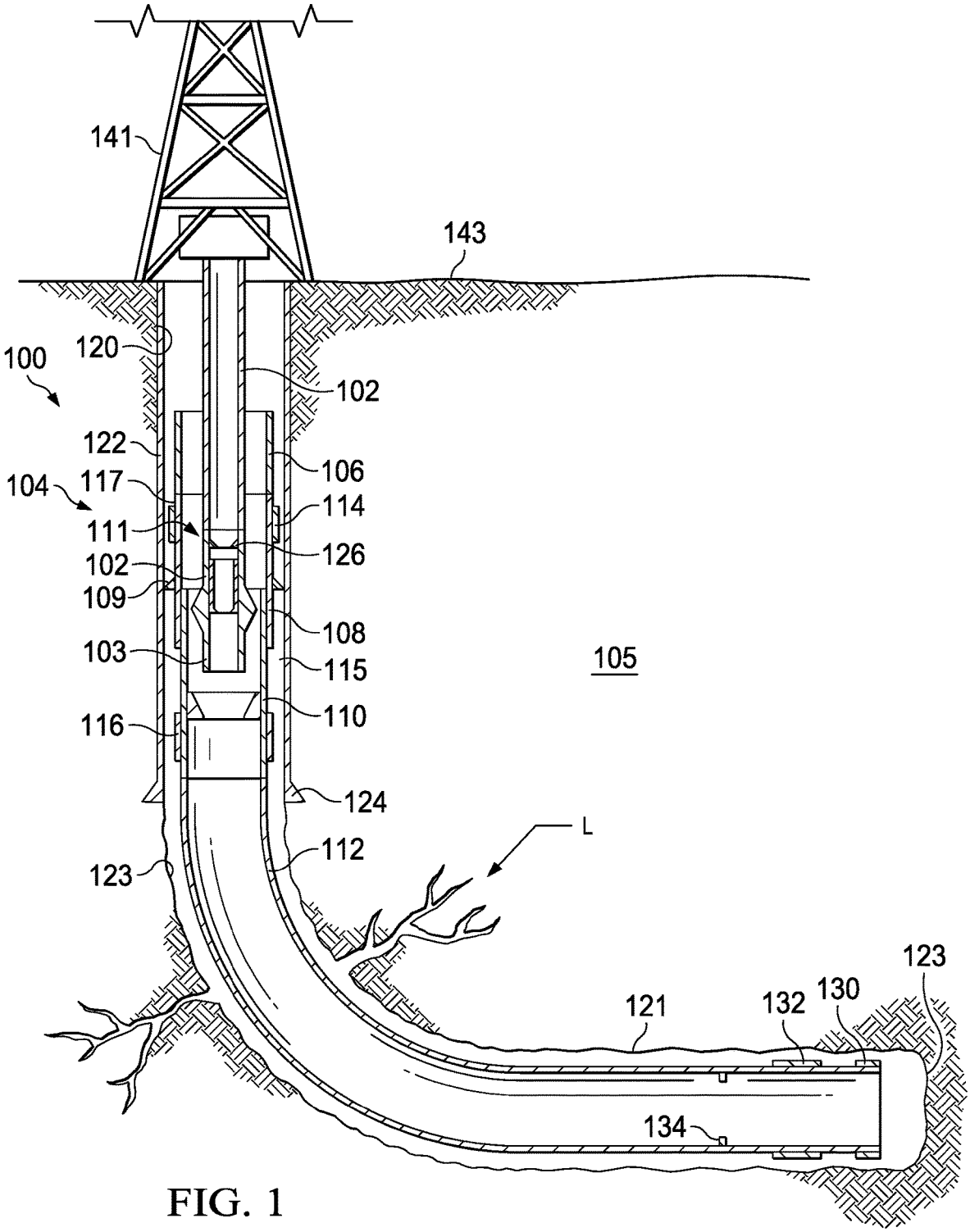
FIG. 1 is a front schematic view, partially cross sectional, of a wellbore assembly according to implementations of the present disclosure.
Figure 2:
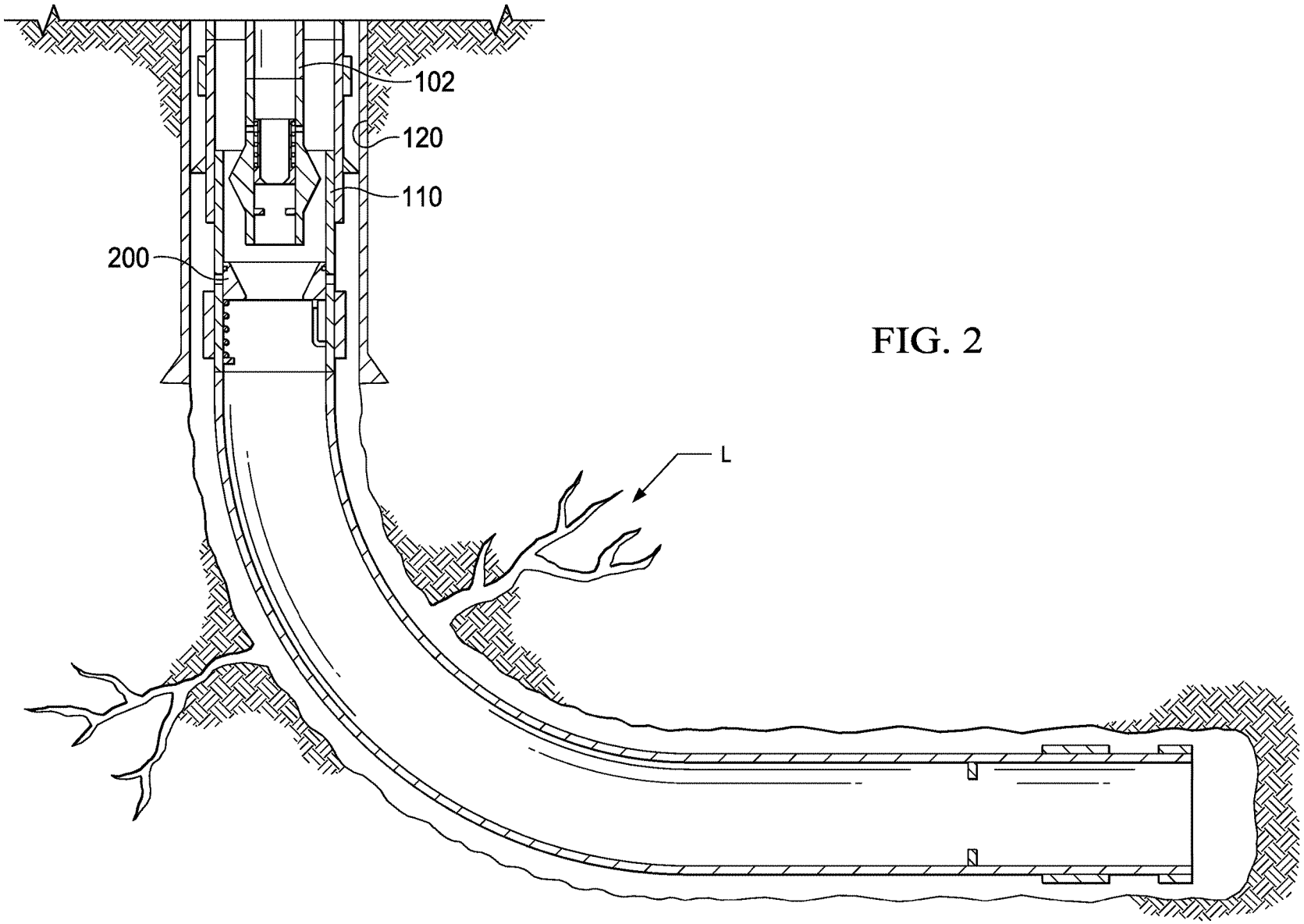
FIGS. 2-6 are front schematic views, cross sectional, of sequential steps to cement a wellbore with the wellbore assembly of FIG. 1.

FIG. 1 shows a wellbore assembly 100 or cementing assembly used to cement a wellbore 120 that has a loss circulation zone 'L'. The wellbore 120 extends from a ground surface 143 of the wellbore 120 to a downhole end 123 of the wellbore, and can be non-vertical (as shown in FIG. 1) or vertical. The wellbore 120 is formed in a geologic formation 105 that includes a hydrocarbon reservoir from which hydrocarbons can be extracted. The loss circulation zone 'L' is a zone where the drilling or production fluids leave the wellbore and are lost in the formation. For example, the loss circulation zone 'L' can include cavernous formations, natural or induced fractures or fissures, or high permeability formations.

The wellbore 120 has a casing 122 that extends from the surface 143 to a casing shoe 124. The wellbore 120 also includes an open hole section 121 (e.g., a well section without casing) that extends between the casing shoe 124 and the downhole end 123 of the wellbore 120. The loss circulation zone 'L' can be located at the open hole section 121 of the wellbore 120.

The wellbore assembly 100 extends from a rig 141 that is located at the surface 143 of the wellbore. The wellbore assembly 100 includes a work string 102 coupled to the rig 141 and a liner assembly 104 attached to the work string 102. The work string 102 is disposed within the wellbore 120 and lowered to place the liner assembly 104 close to the loss circulation zone 'L'. The work string 102 is a piping string that flows fluid (e.g., drilling fluid and cement) from the surface 143 of the wellbore to the liner assembly 104.

The work string 102 is attached to (or includes) an activation sub 103 at a downhole end of the work string 102. As further described in detail below with respect to FIGS. 2-5, the activation sub 103 is used to activate the packers of the liner assembly 104 to set components of the liner assembly 104 on the wall of the wellbore 120.

The liner assembly 104 can be releasably coupled to a downhole end 111 of the work string 102. The liner assembly 104 can include a polished bore receptacle 106, a liner hanger 108 attached to a downhole end of the polished bore receptacle 106 (PBR), a cementing sub 110 attached to (e.g., hanging from) the liner hanger 108, and a liner 112 attached to the cementing sub 110. When attached to the liner assembly 104, at least a portion of the work string 102 extends inside the polished bore receptacle, with an end of the work string 102 attached to a bore of the liner hanger 108.

The PBR 106 has an internal diameter or receptacle that provides a sealing surface. The PBR 106 works as an expansion joint and a separation tool that allows the work string 102 to be stung in and out of the receptacle multiple times without losing sealing capability within the wellbore 120.

The liner hanger 108 can be attached to and fluidically coupled to the work string 102. The liner hanger 108 includes one or more slips 109 and a sealing element 114 (e.g., a packer) that, when engaged with a wall 113 of the wellbore 120, forms a seal in a casing annulus 115. The casing annulus 115 is defined between an external surface 117 of the liner hanger 108 and the wall 113 of the wellbore 120. The liner hanger 108 is made up to the liner string. The packer 114 can be configured to be set hydraulically on the casing 122. For example, the packer 114 can be set under fluidic pressure that is applied by the work string 102 after dropping a ball (e.g., a ball with a 1.5-inch outer diameter) on a ball seat 126 top block a fluid pathway of the work string. The work string 102 can be attached to the liner hanger 108 with an internal latch system that can include shear fasteners. After running the assembly to depth and setting the liner hanger 108, the work string 102 can be separated from the liner hanger 108 by shearing the screws hydraulically (e.g., with the ball in the ball seat 126), or mechanically by rotating the string a pre-determined number of turns to shear the fasteners.

The cementing sub 110 is attached to and disposed between the liner hanger 108 and the liner 112. Initially, the cementing sub 110 is fluidically coupled to the liner hanger 108, the work string 102, and the liner 112. The cementing sub 110 has a sealing element or annulus packer 116 that is set on a wall of the wellbore 120 uphole of the loss circulation zone 'L'. For example, the annulus packer 116 can be set on the wall 113 of the casing 122 or on a wall 123 of the open hole section 121 of the wellbore 120. As further described in detail below with respect to FIGS. 2-5, the annulus packer 116 is set, under string weight applied by the work string 102, on the wall 113 the wellbore 120 uphole of the loss circulation zone 'L' to allow cementing of the casing annulus 115. The casing annulus 115 extends uphole from the annulus packer 116.

The liner 112 includes a float shoe 130 at a downhole end of the liner 112, a float collar 132, and a landing collar 134 that receives a wiper plug after the first cementing operation of the wellbore 120. The length of the liner 112 can be selected based on the distance from the loss circulation zone 'L' to the downhole end 123 of the wellbore 120. To begin a cementing operation, the work string 102 lowers the liner assembly 104 within the wellbore 120 to dispose the cementing sub 110 uphole of the loss circulation zone 'L' so that the float shoe 130 of the liner 112 is disposed close to the downhole end 123 of the wellbore 120.

FIGS. 2-6 show a cementing operation of a wellbore with a loss circulation zone, according to implementations of the present disclosure. As described earlier and shown in FIG. 2, the liner hanger 108 is set on the wall 122 of the wellbore by applying fluidic pressure to the liner hanger 108 through the work string 102. The liner hanger can be set mechanically or hydraulically, and the work string 102 can be released from the liner hanger 108 mechanically or hydraulically. For example, if the work string 102 is unable to be hydraulically released from hanger 108, the work string 102 can be released mechanically via rotation (e.g., after shearing the ball seat with up to 3,000-3,500 psi pressure applied from the surface).

Figure 3:
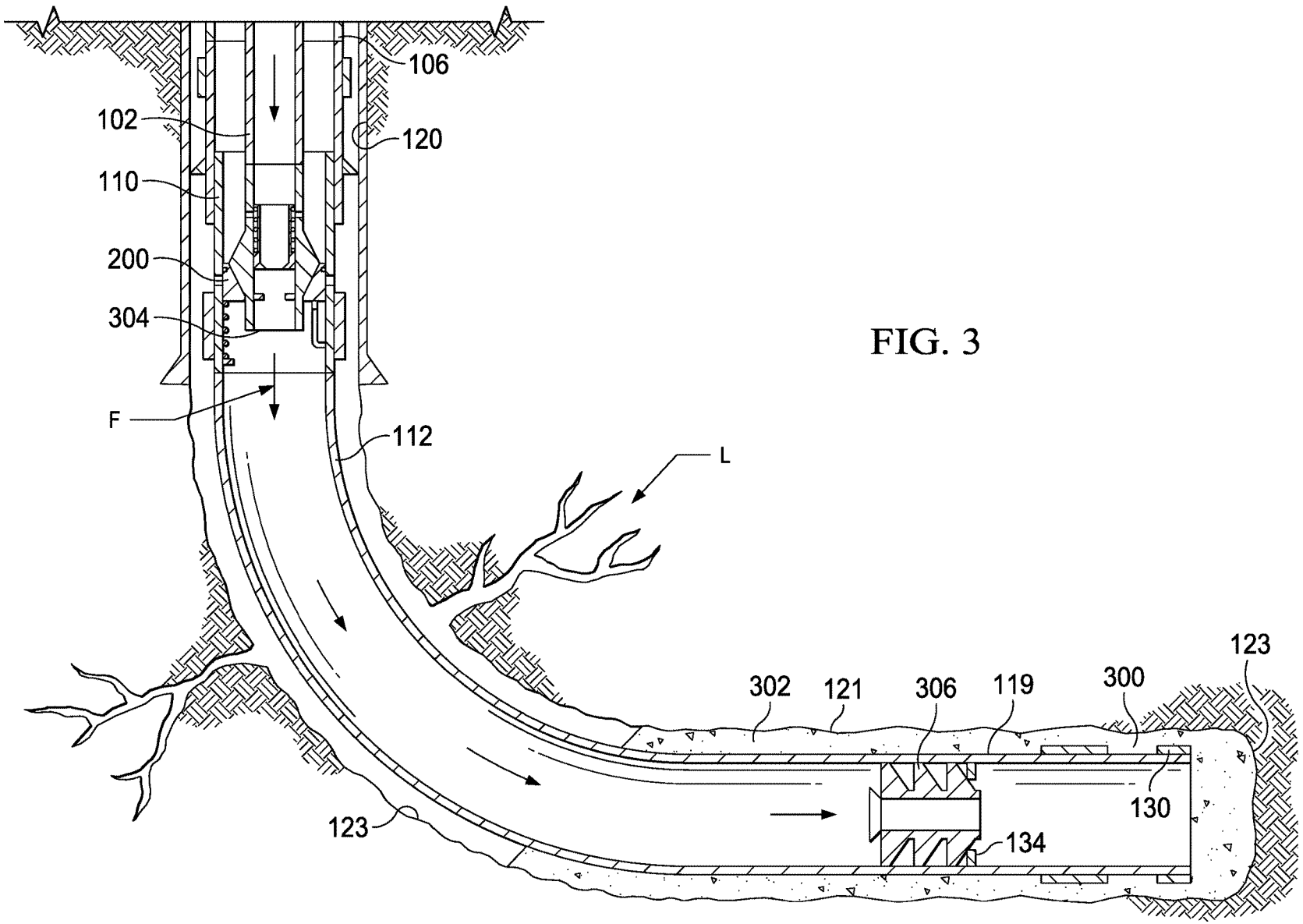

Referring to FIG. 3, after setting the liner hanger 108 on the casing 122 and the work string 102 is disengaged from the liner hanger 108, the liner hanger 108 is moved downhole to form a fluid seal with the internal mandrel 200 of the cementing sub 110. In such an arrangement, the work string 102 is fluidically coupled to the liner 112. With the seal formed, the work string 102 flows cement 300 to an open hole annulus 302 of the wellbore 120. For example, the work string 102 flows cement 300 from the surface of the wellbore to an open end of the work string 304 that is in fluid communication with the liner 112. The cement flows from the work string 102 to the liner 112 to an open end at the float shoe 130 of the liner to exit the liner 112. The cement 300 flows from the liner 112 to the open hole annulus 302 of the wellbore 120. The open hole annulus 302 is defined between an external surface 119 of the liner 112 and the wall 122 of the open hole section 121 of the wellbore 120. The open hole annulus 302 extends between the loss circulation zone 'L' and the downhole end 123 of the wellbore 120.

After cementing the open hole annulus 302, a wiper plug 306 is placed in the work string 102 and moved downhole by fluid 'F' (e.g. drilling mud) flown from the surface of the wellbore 120. The plug 306 is pushed to the landing collar 134 of the liner 112 to stop the fluid 'F' from exciting the liner 112.

After the cement has been placed in the open hole annulus 302, the work string 102 can be pulled back enough to get the end of the work string at least 10 to 20 feet above the polished bore receptacle 106. The work string 102 can be then reverse-circulated to flush the work string 102, moving the cement slurry away from ball seat areas.

Figure 4:
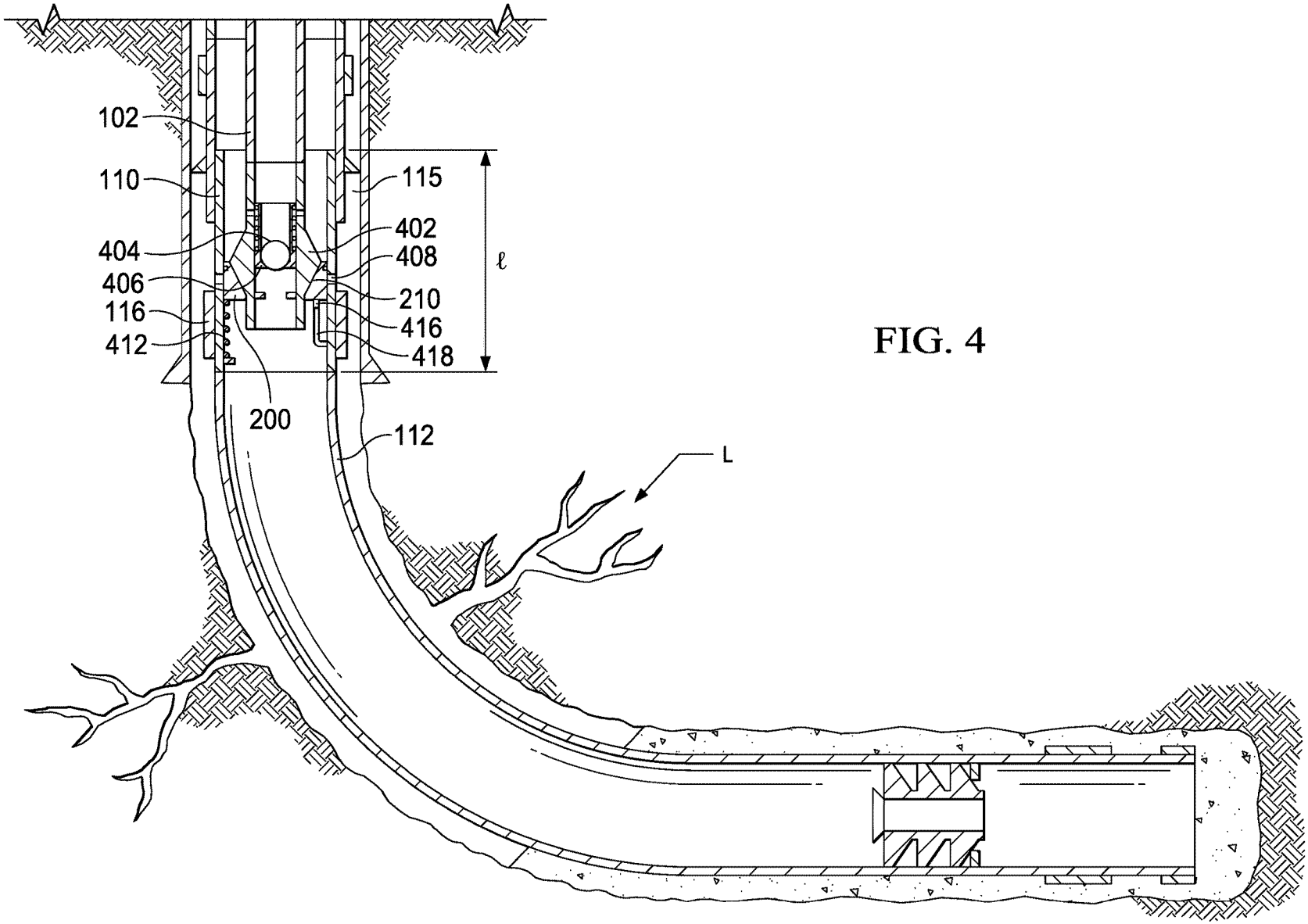

Referring now to FIG. 4, the work string 102 can have locking dogs 402 or shoulders that are released when the work string 102 is pulled back. The shoulders 402 engage the cementing sub 110 to push the mandrel 200 in a downhole direction. With the locking dogs 402 released, the work string 102 is lowered slowly toward the cementing sub 110 while pumping fluid at low rates (e.g., two to three BPM). The internal mandrel has a profile defined by a seat 210 that receives and engages with the locking dogs 402 of the work string 102.

Once the work string 102 engages the profile of the cementing sub 110, the work string 102 stops pumping fluid and a second ball 404 (e.g., a ball with an outer diameter of 1.75 inches) is dropped from the surface through the work string 102 to land at a second ball seat 406 of the work string 102. The ball 404 chokes the flow path between the work string 102 and the liner 112. To determine that the locking dogs 402 are engaged with the cementing sub 110, a technician can determine that there has been a pressure spike as the locking dogs engage and seal the cementing sub profile. Additionally, a technician can confirm proper engagement with 5-10 kip pick up weight.

Figure 5:
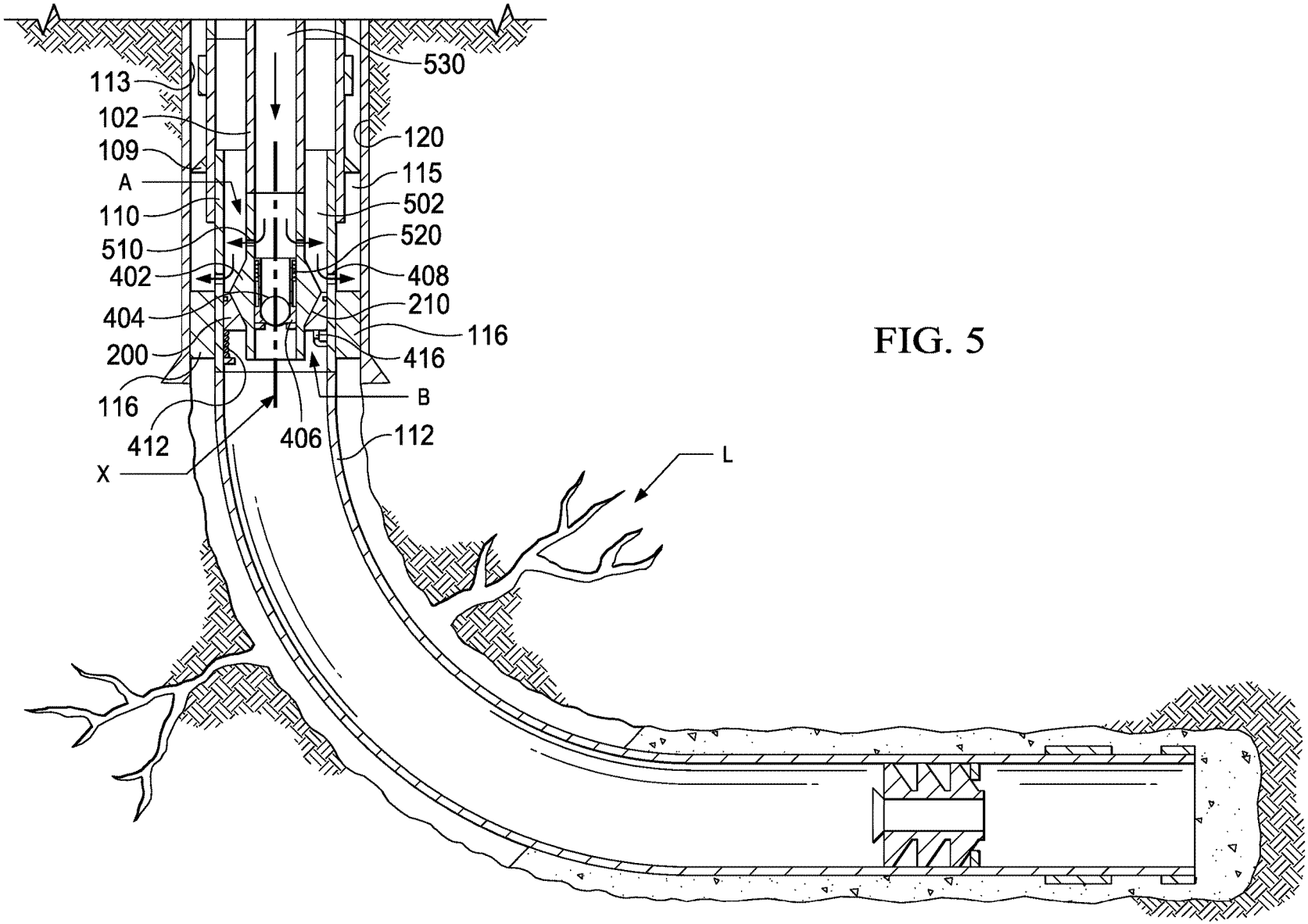

As shown in FIG. 5, with the locking dogs 402 engaged, the work string 102 can expose fluid ports 408 of the cementing sub 110 to establish a fluid pathway between a bore 502 of the cementing sub 110 and the casing annulus 115. For example, as shown in FIG. 4, the internal mandrel 200 can be spring loaded by an internal spring 412 that urges the internal mandrel 200 in an uphole direction parallel to a length 'l' of the cementing sub 110. With the spring 412 extended, the internal mandrel 200 covers the fluid ports 408 of the cementing sub 110. As shown in FIG. 5, when the spring 412 is compressed, the internal mandrel 200 is past the fluid ports 408 to expose the fluid ports 408.

The work string 102 pushes the internal mandrel 200 by applying string weight of about 20 to 30 kip or more, incrementing the weight by 5 kip increments. The mandrel 200 can be designed to travel at least 10 to 15 feet over and above an estimated string stretch (and the work string can be marked at the surface to physically measure distance travelled). Once the mandrel 200 has travelled the predetermined distance, the fluid ports 408 are uncovered and ready to flow cement to the casing annulus 115. The shoulder 402 forms, with the seat 210, a fluid seal between a bore section 'A' of the cementing sub 110 upstream of the seat 210 and a bore section 'B' of the cementing sub 110 downstream of the seat 210 (or the liner 112) to prevent cement from flowing into the bore section 'B' of the cementing sub 100 downstream of the seat 210 during cementing of the casing annulus 115.

Additionally, the mandrel movement mechanically activates the annulus packer 116. For example, as shown in FIG. 4, the mandrel 200 can have an activation arm 416 extending from a downhole end of the mandrel 200. The activation arm 416 extends through a longitudinal slot 418 (e.g., a J-slot) of the cementing sub 110. The activation arm 416 moves along the slot 418 as the mandrel 200 moves in a downhole direction. As shown in FIG. 5, the arm 416 activates, with the spring 412 compressed, the annulus packer 116 to set the annulus packer 116 on the wall 113 of the wellbore 120. For example, the packer 116 can be configured to be set mechanically (e.g., configured to be set by tubing rotation or upward and downward movement). It can be desirable that little movement or rotation will occur to expose the slips of the packer 116. The activation arm 416 extends the packer slips outwards to allow the packer 116 to engage the casing 113 of the wellbore 120, and once extended, the packer 116 can be mechanically set with rotation. The J-slot 418 can help ensure that there is a longitudinal space to accommodate the activation arm 416 during rotation of the work string once the arm 416 has activated the packer 116. Additionally, the annulus packer 116 can be designed to have bi-directional sealing capability for added well integrity barrier.

The work string 102 can establish circulation between the work string 102 and the bore 502 of the cementing sub 110 by opening a second set of fluid ports 510. For example, the ball seat 406 can be spring loaded by a second spring 520 that allows movement of the second ball seat 406 along a central longitudinal axis 'X' of the work string 102. The spring 520 compresses under fluidic pressure from the work string 102 to allow the ball seat 406 to move downhole with the ball 404, thereby uncovering the fluid ports 510 of the work string 102. Exposing the work string ports 510 establishes a fluid pathway between a bore 530 of the work string 102 and the bore 502 of the cementing sub 110 to cement the casing annulus 115. Thus, the work string 102 applies fluidic pressure to the second ball 404 to compress the spring, thereby moving the ball seat 406 and exposing the fluid ports 510 of the work string 102.

To confirm that all the circulation ports 408 and 510 are open, a technician can stroke the cement unit or rig pumps from one to two BPM. If no sudden increase in pressure is observed at the surface, it is determined that the fluid ports are open and ready for the second cementing operation. If sudden pressure is observed at the surface, the steps to open both sets of fluid ports can be performed again.

The second cementing operation includes flowing cement through the work string 102 and out the ports 510 of the work string, into the bore section 'A' of the cementing sub 110 upstream of the seat 210. The cement then flows through fluid ports 408 of the cementing sub 110 into the casing annulus 115. Cement can be flown until pressure lock-up is observed at the surface. The cement can fill the casing annulus 115 from the annulus packer 116 to the slips 109 of the liner hanger 108.

Figure 6:
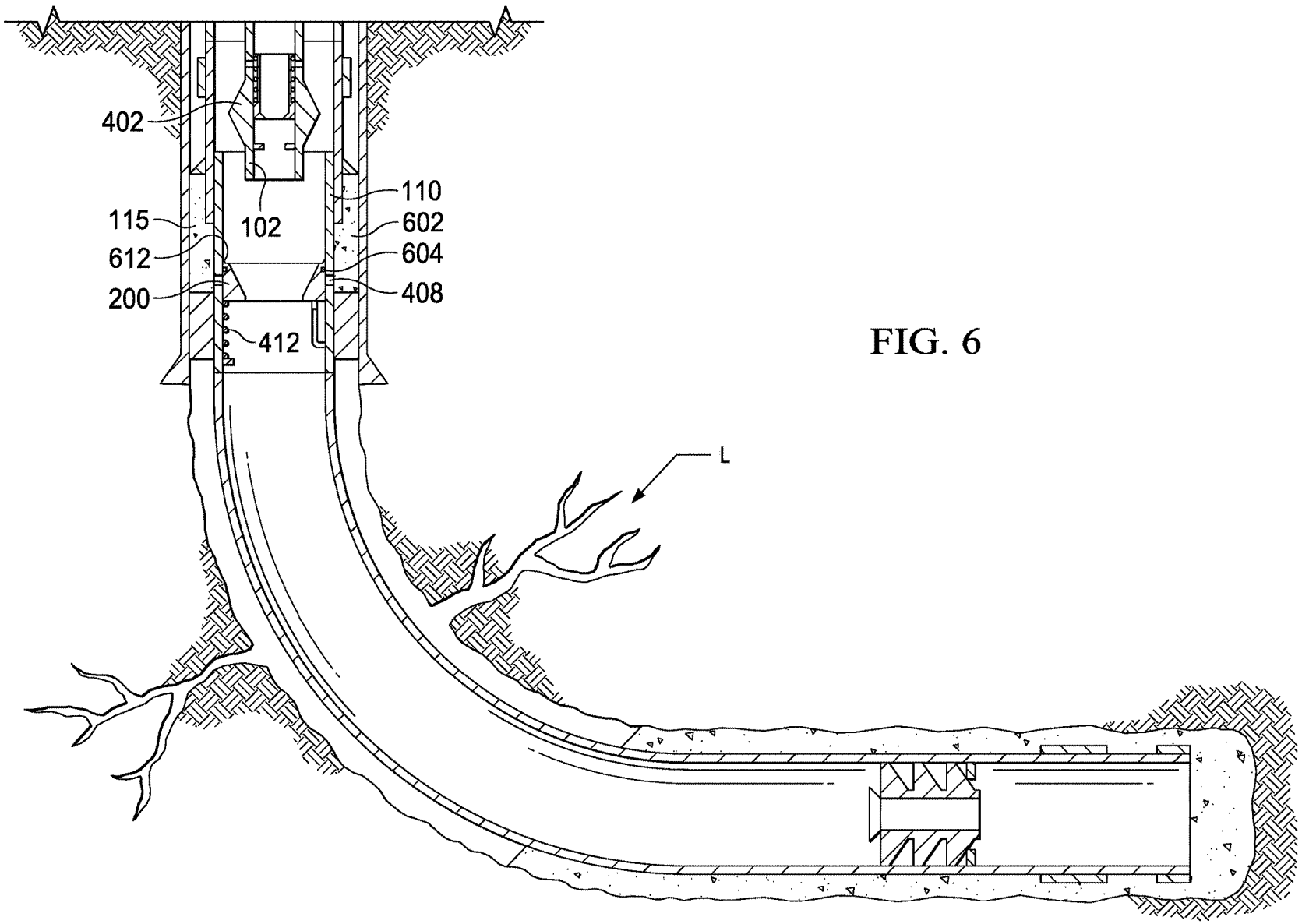

As shown in FIG. 6, after the cement squeeze job has been completed and the cement 602 uphole of the loss circulation zone 'L' has been placed, the work string 102 can be flushed with a spacer and then picked up (e.g., with 20 kip above string weight) to disengage the locking dogs 402 from the cementing sub 110. Once disengaged, the circulation ports 408 of the cementing sub 110 are closed by the mandrel 200 moving back to its original position. For example, the potential energy stored in the compressed spring 412 causes the mandrel to move uphole to cover the fluid ports 408. The mandrel 200 can have one or more sealing rings 604 (e.g., O-rings) to prevent fluid from flowing into the ports 408 when the mandrel 200 is covering the ports 408. The spring 412 can have a stiffness such that the closing force after the string weight is picked up is capable of crushing and closing against any cement or debris in its path when closing. The leading edge 612 of the mandrel 200 can be sharp for improved closing of the ports 408.

After picking up the work string 102, the work string 102 can be reverse circulated to flush any residual cement slurry in the hole. For example, reverse circulation can include intentional pumping of wellbore fluids down the well annulus, and taking returns back to surface through the work string.

Once the cement 602 in the casing annulus 115 has cured, the integrity of the cement can be tested or confirmed by reopening the circulation ports to confirm 'pressure lock up'. Port collar integrity in the "close" position can be verified via subsequent pressure testing. After the cement has been rested, the packer of the liner hanger can be set to seal the wellbore.

Figure 7:
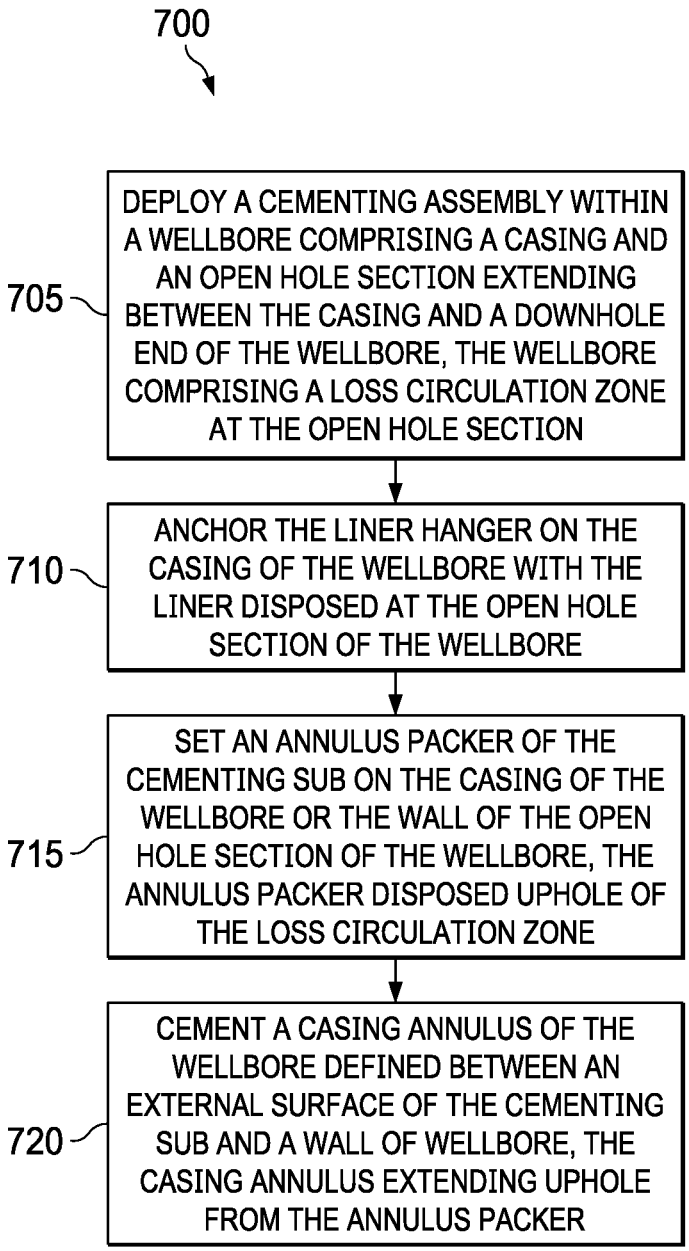
FIG. 7 is a flow chart of an example method of cementing a wellbore with a loss circulation zone.

FIG. 7 shows a flow chart of an example method 700 of cementing a wellbore with a loss circulation zone. The method includes deploying a cementing assembly within a wellbore comprising a casing and an open hole section extending between the casing and a downhole end of the wellbore, the wellbore comprising a loss circulation zone at the open hole section. The cementing assembly includes a work string, and a liner assembly coupled to the work string. The liner assembly includes a polished bore receptacle, a liner hanger attached to a downhole end of the polished bore receptacle, a liner, and a cementing sub attached to and disposed between the liner hanger and the liner (705). The method also includes anchoring the liner hanger on the casing of the wellbore with the liner disposed at the open hole section of the wellbore (710). The method also includes setting an annulus packer of the cementing sub on the casing of the wellbore or the wall of the open hole section of the wellbore, the annulus packer disposed uphole of the loss circulation zone (715). The method also includes cementing a casing annulus of the wellbore defined between an external surface of the cementing sub and a wall of wellbore, the casing annulus extending uphole from the annulus packer (720).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

What is claimed is:

1. A method comprising:

deploying a cementing assembly within a wellbore comprising a casing and an open hole section extending between the casing and a downhole end of the wellbore, the wellbore comprising a loss circulation zone at the open hole section, the cementing assembly comprising: a work string, and a liner assembly coupled to the work string, the liner assembly comprising a polished bore receptacle, a liner hanger attached to a downhole end of the polished bore receptacle, a liner, and a cementing sub attached to and disposed between the liner hanger and the liner;

anchoring the liner hanger on the casing of the wellbore with the liner disposed at the open hole section of the wellbore;

cementing an open hole annulus of the wellbore defined between an external surface of the liner and a wall of the open hole section of the wellbore, the open hole annulus extending between the loss circulation zone and the downhole end of the wellbore;

setting an annulus packer of the cementing sub on the casing of the wellbore or the wall of the open hole section of the wellbore, the annulus packer disposed uphole of the loss circulation zone; and cementing a casing annulus of the wellbore defined between an external surface of the cementing sub and a wall of wellbore, the casing annulus extending uphole from the annulus packer;

wherein cementing the casing annulus comprises lowering the work string to engage and push, with the work string, the cementing sub in a downhole direction, exposing a fluid port of the cementing sub, and then flowing cement through the exposed fluid port into the casing annulus.

2. The method of claim 1, wherein cementing the open hole annulus comprises fluidically coupling the work string with the liner, and then flowing cement through the work string, into the liner, and out an open end of the liner into the open hole annulus of the wellbore.

3. The method of claim 1, wherein the cementing sub comprises a spring loaded mandrel movable in a direction parallel to a length of the cementing sub, the mandrel configured to engage the annulus packer, and setting the annulus packer comprises pushing downhole, with the work string, the mandrel until the mandrel engages the annulus packer to activate the annulus packer.

4. The method of claim 3, wherein the mandrel comprises an arm configured to extend through a longitudinal slot of the cementing sub, and setting the annulus packer comprises pushing downhole, with the work string, the mandrel moving the arm along the longitudinal slot until the arm engages the annulus packer to activate the annulus packer.

5. The method of claim 3, wherein the work string comprises an outwardly projecting shoulder and the spring loaded mandrel comprises an inwardly projecting seat configured to receive and form a fluid seal, with the outwardly projecting shoulder, between a bore section of the cementing sub upstream of the seat and a bore section of the cementing sub downstream of the seat, and pushing the mandrel comprises exposing the fluid port of the cementing sub residing at the bore section of the cementing sub upstream of the seat, and cementing the casing annulus comprises flowing cement through the work string, into the bore section of the cementing sub upstream of the seat, and through the fluid port of the cementing sub into the casing annulus.

6. The method of claim 1, wherein the work string comprises a spring loaded sleeve, and fluidically coupling the work string with the liner comprises pushing, with a fluid and under fluid pressure, the sleeve in a downhole direction, exposing a fluid port of the work string.

7. The method of claim 6, wherein cementing the casing annulus comprises:

closing, with a ball landed on a ball seat of the sleeve, a fluid pathway of the work string, flowing cement through the work string to push downhole, with pressure applied by the cement, the ball seat exposing a fluid port of the work string, and flowing the cement through the fluid port of the work string into the bore section of the cementing sub upstream of the seat, and through the fluid port of the cementing sub into the casing annulus.

8. The method of claim 1, wherein anchoring the liner hanger comprises dropping a ball on a ball seat of the work string, and hydraulically activating slips of the liner hanger.

9. The method of claim 1, further comprising, after cementing the casing annulus, setting a packer of the liner hanger.

10. The method of claim 9, wherein setting the packer of the liner hanger comprises dropping a ball on a ball seat of the work string, and hydraulically activating the packer of the liner hanger.

11. A wellbore assembly comprising:

a work string configured to be disposed within a wellbore comprising a casing and an open hole section extending between the casing and a downhole end of the wellbore, the wellbore comprising a loss circulation zone at the open hole section of the wellbore; and a liner assembly releasably coupled to a downhole end of the work string, the liner assembly comprising:

a polished bore receptacle, a liner hanger attached to a downhole end of the polished bore receptacle, the liner hanger fluidically coupled to the work string and comprising a packer configured to be set on the casing by fluidic pressure from the work string, a liner, and a cementing sub attached to and disposed between the liner hanger and the liner, the cementing sub comprising an annulus packer configured to be set on a wall of the wellbore uphole of the loss circulation zone, the cementing sub comprising an internal mandrel movable in a direction parallel to a length of the cementing sub to activate the packer and to expose or cover a fluid port of the cementing sub such that, when exposed, the fluid port fluidically couples a bore of the cementing sub with a casing annulus defined between an external surface of the cementing sub and the wall of the wellbore, the casing annulus extending uphole from the annulus packer.

12. The wellbore assembly of claim 11, wherein at least a portion of the work string is configured to extend inside the polished bore receptacle, with an end of the work string configured to be attached to a bore of the liner hanger.

13. The wellbore assembly of claim 11, wherein the work string comprises a ball seat configured to receive a ball blocking a fluid pathway of the work string to hydraulically activate an anchor of the liner hanger.

14. The wellbore assembly of claim 13, wherein the packer of the liner hanger is configured to be set hydraulically under pressure applied by fluid stopped at the ball seat.

15. The wellbore assembly of claim 11, wherein the work string is configured to flow cement from a surface of the wellbore to an open end of the work string into the liner, and the liner is configured to flow the cement received from the work string to a float shoe of the liner and out the liner into an open hole annulus of the wellbore defined between an external surface of the liner and a wall of the open hole section of the wellbore, the open hole annulus extending between the loss circulation zone and the downhole end of the wellbore.

16. The wellbore assembly of claim 11, wherein the cementing sub comprises an internal spring configured to urge the internal mandrel in an uphole direction to cover the fluid port of the cementing sub, the internal mandrel comprising a seat and the work string comprising a shoulder configured to engage the seat to push the mandrel in a downhole direction thereby compressing the spring and uncovering the fluid port, the internal mandrel configured to engage, with the spring compressed, the annulus packer to set the annulus packer.

17. The wellbore assembly of claim 16, wherein the mandrel comprises an arm configured to extend through a longitudinal slot of the cementing sub and configured to activate, with the spring compressed, the annulus packer to set the annulus packer.

18. The wellbore assembly of claim 16, wherein the shoulder is configured to form, with the shoulder of the work string, a fluid seal between a bore section of the cementing sub upstream of the seat and a bore section of the cementing sub downstream of the seat to prevent cement from flowing into the bore section of the cementing sub downstream of the seat during cementing of the casing annulus.

19. The wellbore assembly of claim 11, wherein the work string comprises a ball seat and an internal spring configured to urge the ball seat in an uphole direction to cover a fluid port of the work string, the ball seat configured to receive a ball that, when disposed on the ball seat, prevents fluid from flowing into the liner, the spring configured to compress under fluidic pressure from the work string to allow the ball seat to move downhole thereby uncovering the fluid port of the work string to establish a fluid pathway between a bore of the work string and a bore of the cementing sub to cement the casing annulus.

20. A cementing assembly comprising:

an activation sub fluidically coupled to a work string configured to be disposed within a wellbore that comprises a casing and an open hole section extending between the casing and a downhole end of the wellbore, the wellbore comprising a loss circulation zone at the open hole section of the wellbore; and a liner assembly releasably coupled to the activation sub, the liner assembly comprising:

a liner hanger fluidically coupled to the activation sub and comprising a packer configured to be set on the casing by fluidic pressure from the work string, a liner, and a cementing sub attached to and disposed between the liner hanger and the liner, the cementing sub comprising an annulus packer, the cementing sub configured to set, under string weight applied by the work string, the annulus packer on a wall of the wellbore uphole of the loss circulation zone, to allow cementing of a casing annulus defined between an external surface of the cementing sub and the wall of the wellbore, the casing annulus extending uphole from the annulus packer.

21. The cementing assembly of claim 20, wherein the cementing sub comprises an internal mandrel movable by the weight applied by the work string in a direction parallel to a length of the cementing sub to activate the packer and to expose or cover a fluid port of the cementing sub such that, when exposed, the fluid port fluidically couples a bore of the cementing sub with the casing annulus to allow cement to be flown to the casing annulus.

* * * * *